US006074501A

United States Patent [19]

Baxter et al.

[11] Patent Number: 6,074,501

[45] Date of Patent: Jun. 13, 2000

[54] HEAT TREATMENT FOR ALUMINUM CASTING ALLOYS TO PRODUCE HIGH STRENGTH AT ELEVATED TEMPERATURES

[75] Inventors: William John Baxter, Bloomfield Hills; Anil Kumar Sachdev, Rochester Hills, both of Mich.

[73] Assignee: General Motors Corporation, Detroit, Mich.

[21] Appl. No.: 09/340,365

[22] Filed: Jun. 28, 1999

[51] Int. Cl.[7] ..... C22C 21/00; C22C 21/02; C21D 1/00

[52] U.S. Cl. ..... 148/700; 148/702

[58] Field of Search ..... 148/415, 417, 148/700, 702

[56] References Cited

U.S. PATENT DOCUMENTS

| | | | |
|---|---|---|---|
| 2,381,714 | 8/1945 | Beck et al. | 148/2 |
| 3,620,854 | 11/1971 | Greenewald, Jr. | 148/32 |
| 4,336,076 | 6/1982 | Edamura et al. | 148/3 |
| 4,648,918 | 3/1987 | Asano et al. | 148/439 |
| 4,786,340 | 11/1988 | Ogawa et al. | 148/439 |
| 4,934,442 | 6/1990 | Futamura et al. | 164/76.1 |
| 5,123,973 | 6/1992 | Scott et al. | 148/690 |
| 5,336,344 | 8/1994 | Wei | 148/549 |
| 5,340,418 | 8/1994 | Wei | 148/549 |
| 5,851,320 | 12/1998 | Auran et al. | 148/552 |
| 5,853,508 | 12/1998 | Tack et al. | 148/550 |

FOREIGN PATENT DOCUMENTS

| | | |
|---|---|---|
| 0191765 | 8/1989 | Japan . |

*Primary Examiner*—George Wyszomierski
*Assistant Examiner*—Janelle Combs Morillo
*Attorney, Agent, or Firm*—George A. Grove

[57] ABSTRACT

An aluminum casting of composition that is hardenable due to the presence of suitable amounts of silicon, magnesium and, optionally, other hardening constituents such as copper, nickel and the like is heat treated for improved tensile strength at 300° C. The casting, which as formed has a microstructure of aluminum rich dendrites, silicon particles and hardening particles, is reheated above 500° C. to redissolve the hardening particles and redistribute hardening constituents through the aluminum dendrites, cooling the casting to 350° C. to 450° C. and holding there to reform an abundance of large stable hardening precipitates in the aluminum dendrites and then air cooling the casting. The thus treated casting may then be artificially age hardened such as by a T5 temper practice.

9 Claims, 1 Drawing Sheet

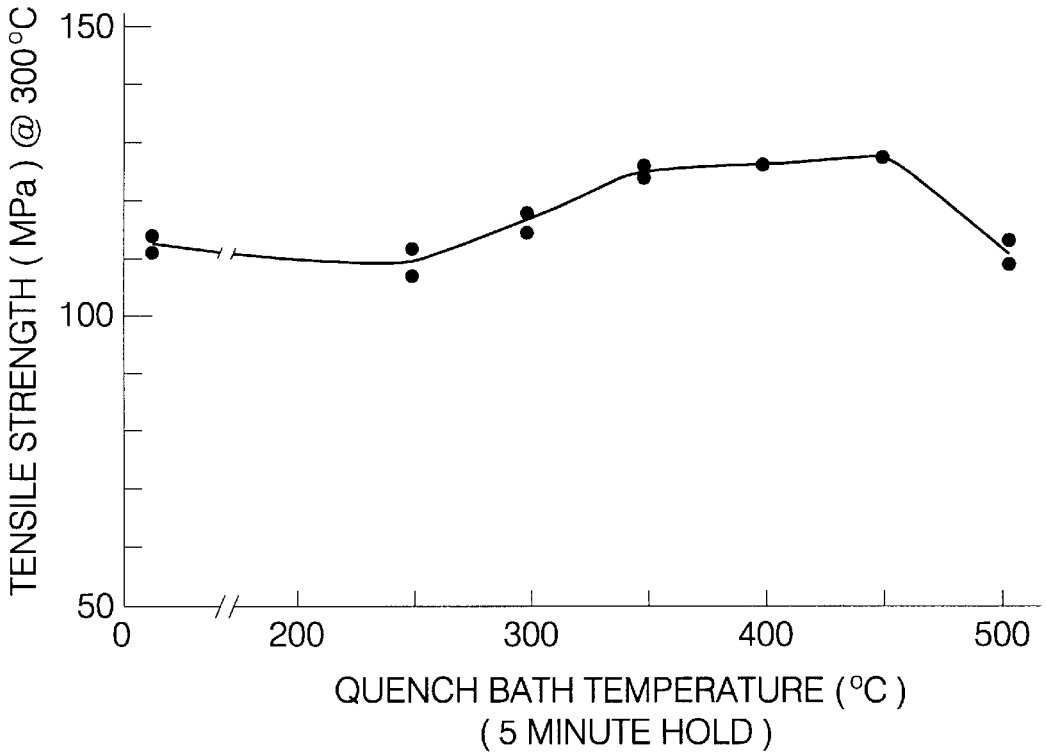
TENSILE STRENGTH ( MPa ) @ 300°C
150
100
50
0
200
300
400
500
QUENCH BATH TEMPERATURE (°C )
( 5 MINUTE HOLD )

HEAT TREATMENT FOR ALUMINUM CASTING ALLOYS TO PRODUCE HIGH STRENGTH AT ELEVATED TEMPERATURES

TECHNICAL FIELD

This invention pertains to aluminum-silicon casting alloys, and more specifically it pertains to a heat treatment for such alloys to provide high strength at elevated temperatures.

BACKGROUND OF THE INVENTION

Aluminum castings are manufactured in large numbers from a variety of aluminum alloys. Such castings find application where relatively low weight and high strength are desired. Among the families of aluminum casting alloys is the series of aluminum silicon alloys that also may contain small amounts of magnesium or magnesium and copper as alloying constituents.

It has long been recognized that the addition of silicon to aluminum dramatically increases the fluidity of such molten alloys for casting complicated shapes. Aluminum and silicon form an eutectic mixture at about 12 weight percent silicon, and hypoeutectic aluminum-silicon alloys, eutectic alloys and hypereutectic aluminum-silicon alloys are used to produce castings. For example, in sand mold castings a silicon content of about 5 to 7% by weight is often employed. For permanent mold castings, a suitable silicon content is often 7% to 9% by weight. For die casting, the silicon content may be about 8% to 12% by weight. There are hypereutectic aluminum-silicon casting alloys in which the silicon content is 16% to 20% by weight.

Magnesium or magnesium with small amounts of copper and nickel are used as additional strengthening elements in aluminum-silicon casting alloys. In suitably heat treated alloys these elements can form a variety of strengthening phases such as $Mg_2Si$, $CuMgAl_2$ and $CuAl_2$ in addition to the ubiquitous silicon. In addition, more complex intermetallic particles are formed containing various combinations of Ni, Cu, Mg, Si and Fe.

The metallurgical microstructure of aluminum-silicon castings normally comprise dendrites of aluminum-rich composition with silicon particles and precipitated alloying constituents distributed within the dendrite arms. Thus, the chemistry of aluminum-silicon alloys lends itself to hardening or strengthening by heat treatment. The purpose of such practices is to increase the hardness of the casting for improved machinability. An additional purpose is to increase its strength or produce mechanical properties associated with a particular material condition. Heat treatments are also used to stabilize mechanical and physical properties or to ensure dimensional stability as a function of time under service conditions.

There are a number of standard Aluminum Association heat treatment practices and designations for industry use. Among standardized temper designations applicable to casting are:

- T4—in which the casting is solution heat treated, quenched and aged at ambient;
- T5—in which the casting is artificially aged by heating to a suitable temperature of the order of 200° C. for a few hours; and
- T6—in which the casting is solution heat treated, quenched and then artificially aged at about 200° C.

In the solution heat treatment, castings are heated to a temperature to dissolve the soluble constituents in the solid aluminum matrix. For a typical aluminum-silicon casting alloy a suitable solution heat treatment is in the range of about 500° C. to 540° C.

As stated the purpose of all such heat treatments is to increase the hardness and strength of aluminum castings or other work pieces at primarily room temperature. However, while aluminum alloys are not especially known as high temperature materials, some such alloys are used to make automotive pistons, for example, and other products that have utility at elevated temperatures. So it is very desirable to produce aluminum alloy castings with improved tensile strength at elevated temperatures, for example, of the order of 300° C.

SUMMARY OF THE INVENTION

This invention provides a heat treatment process for the family of aluminum-silicon alloy castings of the type that contain silicon and other alloying constituents and rely on these constituents for improved strength. The purpose of this invention is to provide increased strength, e.g., ultimate tensile strength, in castings intended for prolonged exposure at elevated temperatures of the order of 300° C.

In the United States, the Aluminum Association has classified aluminum-silicon-magnesium alloys as either the 1xx or 3xx family of alloys. In general, the practice of this invention is applicable to castings made of these alloys. More specifically, this invention is applicable to aluminum base alloys containing as essential ingredients, in weight proportions, about 4 to 20% silicon, about 0.1 to 2% magnesium and aluminum. The cast alloys also often contain small amounts of one or more of copper (e.g., 1–4%), iron (e.g., 0.2–2%), nickel (e.g., 0.2–3%), manganese (e.g., 0.2–0.6%, titanium (e.g., 0.1–0.3%) or the like as hardening constituents.

Aluminum castings are produced by a variety of practices including sand mold casting, permanent mold casting, squeeze casting, die casting and the like. In accordance with this invention, the casting(s) will be removed from its mold or die. Depending upon the manufacturing layout, the casting may be air cooled and temporarily stored or it may be transported from the casting line while still warm to a suitable heat treatment furnace for the following processing.

The cast material has a microstructure containing aluminum-rich dendrites with phases of silicon and precipitated intermetallic particles and other hardening constituents dispersed amongst the arms of the dendrites. The size and distribution of the particles are a consequence of the thermal history of the casting operation and, consequently, the casting does not have optimal high temperature strength. Accordingly, the castings are heated to a temperature in the range of, for example, 500° C. to 540° C. to dissolve or release magnesium and other alloying elements from the intermetallic precipitates and to redistribute an increased quantity of such elements in solid solution throughout the interior of the aluminum dendrites. Depending upon such factors as casting size and furnace loading, this solutioning step may require from a few minutes to a few hours to complete.

The castings are then quickly cooled to a temperature in the range of about 350° C. to 450° C. for a period of a few minutes up to a few hours. The cooling may be accomplished by transferring the castings to a lower temperature region of a furnace or, for example, by quenching them in a salt bath maintained at a desired temperature. This lower temperature holding period, immediately following the solutioning step, produces throughout the dendritic matrix an abundance of only those hardening particles which are stable at this elevated temperature. It is this new and enhanced distribution of thermally stable particles that ultimately provide high temperature strength to the castings.

Following the brief hold at 350° C. to 450° C. the castings are cooled in air to ambient temperature. The castings can then be subjected to a conventional artificial age hardening process such as a T5 temper practice, but this is not necessary to the invention.

The resulting castings have good ultimate tensile strength at 300° C. after prolonged exposure at that temperature. For example, a group of alumina-silica fiber reinforced, AA339 composite castings were prepared. The castings were processed as described above, held at 300° C. for 300 hours and then subjected to tensile testing at 300° C. They displayed ultimate tensile strengths of 127 MPa.

Other objects and advantages of this invention will become apparent from a detailed description of a preferred embodiment which follows below. In such description reference will be had to the drawing figure that is described in the next section.

BRIEF DESCRIPTION OF THE DRAWINGS

The drawing FIGURE is a graph of tensile strength at 300° C. versus quench bath temperature for AA339 composite castings processed at temperatures both in accordance with this invention and at comparative temperatures.

DESCRIPTION OF THE PREFERRED EMBODIMENT

The practice of the invention will be illustrated in connection with the production of 339 aluminum alloy castings. AA339 is an alloy that is commonly used in permanent mold or squeeze casting operations to produce components such as automotive pistons and the like. The specification for AA339 on a weight basis is 11.0% to 13.0% silicon, 0.5% iron, 1.5% to 3.0% copper, 0.5% manganese, 0.5% to 1.5% magnesium, 0.5% to 1.5% nickel, 0.25% titanium, and the balance substantially aluminum. This is an aluminum-silicon eutectic alloy. While silicon and magnesium are principal contributors to the hardness and strength of the alloy, the other alloying constituents such as copper and nickel also contribute to desirable physical properties of the castings.

A composite casting was prepared containing 15% by volume of Saffil™ fibers (made from 96% alumina and 4% silica) so that the resulting body was an 339 aluminum alloy-Saffil™ composite. (The practice of the invention is equally applicable to an unreinforced alloy because the heat treatment affected only the microstructure of the alloy.) The castings were in the configuration of cylinders and were ejected from the mold and allowed to cool to room temperature.

An examination of the castings revealed a microstructure of aluminum dendrites with interspersed precipitates including silicon and intermetallic compounds of alloying constituents with silicon and aluminum. The tensile and fatigue strength of aluminum casting alloys is largely controlled by the concentration and nature of these precipitates in the aluminum dendrites. It is the purpose of this invention to produce preferentially those thermally stable precipitates necessary for high temperature strength of a casting.

The composite castings described above were heated to about 510° C. (suitably to a temperature in the range of about 500° C. to 540° C.) for three hours sufficient to release and dissolve alloying elements from the precipitated intermetallic particles. This solutionizing treatment redistributes the alloying elements from the positions where they precipitated during the solidification of the cast alloy to positions throughout the dendritic microstructures. Different castings were then quenched or otherwise rapidly cooled from a temperature of about 510° C. to a variety of holding temperatures. The quench and hold temperatures were, respectively, 25° C. 250° C., 300° C., 350° C., 400° C. 450° C., and 500° C. A water quench was used to quench those castings that were rapidly cooled to room temperature. A molten salt bath at controlled temperatures was used for the quenching of the other samples. The samples were held at these respective temperatures for a period of about five minutes and then withdrawn from their quench bath and air cooled to room temperature.

The purpose of solutionizing the castings at 510° C. and then quenching them to intermediate temperatures was to find an optimum condition in which the strengthening elements are redistributed from their locations in the original casting to spread them throughout the cast microstructure and therein to form preferentially the precipitates that are stable at elevated temperatures.

After the castings were cooled to ambient temperature and cleaned, they were given a standard T5 temper practice, i.e., reheated to 210° C. for a period of eight hours and then air cooled to room temperature. This temper ensured casting stability during storage at room temperature prior to testing and is not intrinsic to the subject heat treatment.

To evaluate the long term high temperature strength of such processed castings, they were held at a temperature of 300° C. for 300 hours prior to a tensile strength test. The drawing figure shows the ultimate tensile strength of castings quenched to ambient and at temperatures from 200° C. to 500° C. at 50 degree intervals. It is seen that the optimum strength after 300 hours at 300° C. was attained in the composite castings that had been quenched to and held at temperatures of 350° C., 400° C. and 450° C. The ultimate tensile strength of these materials was in the range of about 125 to 130 MPa.

The above procedure was repeated on an as-cast sample which was solutionized at 510° C. for 10 minutes (rather than three hours) followed by a 400° C. quench bath. After cooling to room temperature and the artificial aging process, the sample had an ultimate tensile strength after exposure to 300° C. of 137 MPa.

While the practice of the invention has been demonstrated with respect to an aluminum alloy 339-Saffil™ composite, the invention is applicable to aluminum-base alloys that contain from 4% to 20% silicon, from 0.1% to 2% magnesium and the balance aluminum. Other alloying constituents for hardening may be present in suitable, usually relatively small amounts.

While the invention has been described in terms of a few specific embodiments, it will be appreciated that other forms of the invention can readily be adapted by one skilled in the art. Accordingly, the scope of this invention is to be considered limited only by the following claims.

What is claimed is:

1. A method of increasing the tensile strength at 300° C. of an aluminum alloy casting, said casting consisting essentially, by weight, of 4 to 20% silicon, aluminum, 0.1 to 2% magnesium as a required hardening constituent and 0 to 4% copper, 0.2 to 2% iron, 0 to 3% nickel as optional hardening constituents, the microstructure of said casting comprising aluminum dendrites, silicon particles and hardening particles containing magnesium and said other hardening constituents if present, said method comprising (a) heating the casting to a temperature of about 500° C. to 540° C. to redissolve at least some of said hardening particles and to redistribute uniformly the redissolved constituents throughout the aluminum dendrites, (b) transferring the casting to a temperature regime in the range of 350° C. to 450° C. and holding the casting in said regime for a period to reprecipitate hardening particles throughout the aluminum dendrites, and (c) cooling the casting to ambient temperature.

2. A method as recited in claim 1 in which the casting is held in said step (a) temperature range for a period of about 10 minutes to three hours.

3. A method as recited in claim 1 in which said casting is held in said step (b) temperature regime for a period in the range of five minutes to three hours.

4. A method as recited in claim 1 further comprising heating the cooled casting to a temperature of about 200° C. to 220° C. holding the casting at said temperature for a period of 6 to 10 hours and cooling the casting to ambient temperature.

5. A method as recited in any one of claims 1–4 in which said alloy consists essentially, by weight, of 8 to 13% silicon, 0.1 to 2% magnesium and aluminum.

6. A method as recited in any one of claims 1–4 in which said alloy consists essentially, by weight, of 8 to 13% silicon, 0.1 to 2% magnesium, 1–4% copper, and aluminum.

7. A method as recited in any one of claims 1–4 in which said alloy consists essentially, by weight, of 8 to 13% silicon, 0.1 to 2% magnesium, 1–4% copper, 0.2–2.0% iron and aluminum.

8. A method as recited in any one of claims 1–4 in which said alloy consists essentially, by weight, of 8 to 13% silicon, 0.1 to 2% magnesium, 1–4% copper, 0.2–2.0% iron, 0.2–3.0% nickel and aluminum.

9. A method as recited in any one of claims 1–4 in which said alloy consists essentially, by weight, of 8 to 13% silicon, 0.1 to 2% magnesium, 1–4% copper, 0.2–0.6% manganese and aluminum.

* * * * *